US005468144A

United States Patent [19]

Iwahori

[11] Patent Number: 5,468,144

[45] Date of Patent: Nov. 21, 1995

[54] GAS LIGHTER

[76] Inventor: Masayuki Iwahori, 15-19 Nakadahoncho, Shizuoka-shi, Shizuoka 422, Japan

[21] Appl. No.: 265,210

[22] Filed: Jun. 24, 1994

[30] Foreign Application Priority Data

Jun. 25, 1993 [JP] Japan ..... 5-180869

[51] Int. Cl.[6] ..... F23Q 1/04

[52] U.S. Cl. ..... 431/254; 431/274; 431/275

[58] Field of Search ..... 431/274, 275, 431/129, 130, 131, 139, 140, 141, 254

[56] References Cited

U.S. PATENT DOCUMENTS 2,715,329 8/1955 Burchett ..... 431/140
3,111,015 11/1963 Smith ..... 431/140

FOREIGN PATENT DOCUMENTS 2619540 11/1976 Germany ..... 431/254

*Primary Examiner*—Carroll B. Dority
*Attorney, Agent, or Firm*—Sughrue, Mion, Zinn, Macpeak & Seas

[57] ABSTRACT

Disclosed is a gas lighter. To use the gas lighter, first, the push-down member is depressed. As a result, the rotary body rotates and the engage pawl of the rotary body engages with the ratchet teeth of the ratchet. This rotates the ratchet, causing the rotary ignition means to rotate. As the rotary ignition means rotates, it rubs against the flint to make sparks, which ignite the gas injected from the gas injection means. To stop using the gas lighter, the depression of the push-down member should be released. Consequently, the push-down member returns by the returning elastic member so that the rotary body rotates in the opposite direction, thus disengaging the engage pawl from the ratchet teeth. At this time, the ratchet teeth and rotary ignition means do not rotate.

6 Claims, 9 Drawing Sheets

GAS LIGHTER

BACKGROUND OF THE INVENTION

1. Field of the Invention

The present invention relates to a gas lighter, and, more particularly, to a gas lighter in which the structure for rotating rotary ignition means, such as a rotary file, is improved, and which is easy to manufacture and can easily be designed compact with an improved ignition efficiency.

2. Description of the Related Art

A conventional flint type gas lighter is designed as follows. The gas lighter has a lighter body with a gas injection nozzle provided at the upper portion of the lighter body, and a rotary file which has a file face on its outer surface and is rotatably attached at the upper portion of the lighter body. A flint is placed inside the lighter body and is urged by a spring to elastically abut on the rotary file. An actuator for rotating the rotary file is attached to the upper portion of the lighter body. One side of the rotary file is provided with segment portions that are equally divided (e.g., by five), with an engage step portion formed in each segment portion. A spring piece having engage pawls, which are detachably engaged with the engage step portions of the segment portions, is provided on the actuator side.

To use the gas lighter with the above structure, first, the actuator is pressed down. The depression of the actuator causes the engage pawls of the spring piece to engage the engage step portion of any one of the segment portions, thus rotating the rotary file. As the rotary file rotates, it rubs against the flint that is pressed against the file face to make sparks. The sparks ignite gas injected from the nozzle.

As mentioned above, the structure for rotating the rotary file in the conventional gas lighter requires that the segment portions be formed on one side of the rotary file with the engage step portion formed on each segment portion and that the spring piece having the engage pawls be provided on the actuator side. It is however difficult to form the segment portions. In manufacturing the rotary file, for example, a metal wire is cut to a predetermined length and the cut wire pieces are pressed into a mold to be cast. To provide the mentioned segment portions then, it is necessary to form the equivalent shapes in the mold. The processing of the rotary file including the preparation of such a mold is very difficult. The production of the conventional gas lighter therefore needs many steps, resulting in a higher manufacturing cost.

Further, the number of segment portions is limited to about five because the shape of the aforementioned mold should become complex to ensure finer segmentation. With the equal segmentation into about five portions, the rotational angle for rotating a single segment portion becomes large so that the amount of depression of the actuator should be increased accordingly. This lowers the ignition efficiency. To reduce the depression amount of the actuator, the number of segment portions should be increased. In this case, again, the shape of the mold becomes complicated.

SUMMARY OF THE INVENTION

Accordingly, it is an object of the present invention to provide a gas lighter in which the structure for rotating rotary ignition means, such as a rotary file, is improved to facilitate its production, thus reducing the number of steps in the production and reducing the cost accordingly, and in which the rotary ignition means is rotatable efficiently, thus significantly improving the ignition efficiency.

To achieve the above object, a gas lighter according to this invention comprises a lighter body for retaining liquid gas and provided with gas injection means; a push-down member depressably attached to the lighter body and urged in a direction opposite to a depressing direction by a returning elastic member; rotary ignition means rotatably attached to the lighter body, with a flint elastically abutting on the rotary ignition means, the rotary ignition means rubbing against the flint when being rotated; a ratchet attached coaxially to the rotary ignition means and having a plurality of ratchet teeth; and a rotary body attached to the ratchet coaxially and rotatably and having an engage pawl, the rotary body being rotatable by depression of the push-down member to permit the engage pawl to engage with the ratchet teeth of the ratchet, thereby rotating the ratchet and the rotary ignition means, the rotary body being rotatable in an opposite direction by releasing of depression of the push-down member to disengage the engage pawl from the ratchet teeth.

To use the gas lighter, first, the push-down member is depressed. As a result, the rotary body rotates and the engage pawl of the rotary body engages with the ratchet teeth of the ratchet. This rotates the ratchet, causing the rotary ignition means to rotate. As the rotary ignition means rotates, it rubs against the flint to make sparks, which ignite the gas injected from the gas injection means.

To stop using the gas lighter, the depression of the push-down member should be released. Consequently, the push-down member returns by the returning elastic member so that the rotary body rotates in the opposite direction, thus disengaging the engage pawl from the ratchet teeth. At this time, the ratchet teeth and rotary ignition means do not rotate.

The rotary ignition means, the ratchet and the rotary body may be covered with a cover, so that the cover is rotated by depression of the push-down member, thus rotating the rotary body.

The rotary body may be provided with a pair of engage pawls at symmetrical positions, so that the pair of engage pawls are respectively engaged with two ratchet teeth arranged at symmetrical positions of the ratchet. This can make the transmission of the rotation more surely and can ensure the well-balanced transmission of the rotation.

A driving elastic member may be installed in the push-down member in such a way that the driving elastic member is compressed and the rotation of the rotary body is restricted by the depression of the push-down member, and the compression of the driving elastic member is spontaneously released to rotate the rotary body after the push-down member is depressed by a predetermined amount.

A movable member, linked to the rotary body in such a way as to receive urging force of the driving elastic member, may be retained movable in the push-down member in such a manner that the depression of the push-down member compresses the driving elastic member and restricts the movement of the movable member due to an engagement with the push-down member, and when the push-down member is depressed by a predetermined amount, the movable member is disengaged from the push-down member to permit the movable member to move, thereby rotating the rotary body.

Alternatively, a movable member, linked to the rotary body in such a way as to receive urging force of the driving elastic member, may be retained movable in the push-down member in such a manner that the depression of the push-down member compresses the driving elastic member and restricts the movement of the movable member due to an engagement of the movable member with a slide member disposed slidably, and when the push-down member is depressed by a predetermined amount, the push-down member disengages the movable member from the slide member and elastic force of the driving elastic member moves the movable member to thereby rotate the rotary body.

DETAILED DESCRIPTION OF THE PREFERRED EMBODIMENTS

Figure 1:
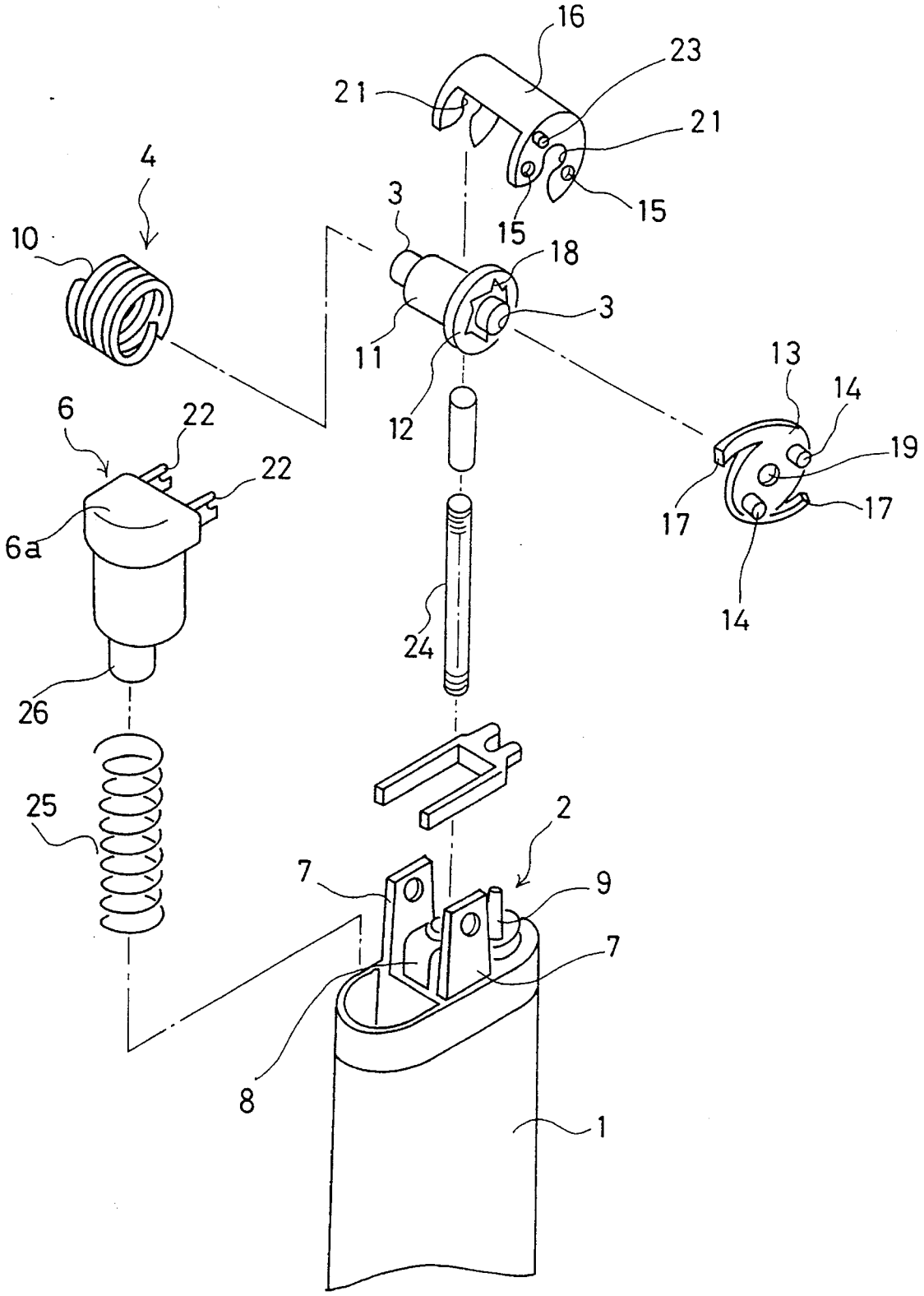
FIG. 1 is an exploded view illustrating the structures of the essential portions of a gas lighter according to a first embodiment of the present invention.

A first embodiment of the present invention will now be described with reference to FIGS. 1 through 3. A gas lighter according to this embodiment has a lighter body 1 with gas injection means 2 provided at the upper portion of the lighter body 1. A rotary file 4 as rotary ignition means is rotatably supported on the lighter body 1 via a pin 3. A flint 5 elastically abuts on the rotary file 4. The rotary file 4 rotates by operating an actuator 6 as a push-down member. Shaft supports 7 are formed at the top portion of a fuel tank provided in the lighter body 1. A recessed flint retainer 8 for retaining the flint 5 is provided between the shaft supports 7.

The gas injection means 2 at the top of the lighter body 1 comprises vapor gas generating means, which includes a vaporization chamber for vaporizing liquid petroleum gas, a gas passage, a gas valve and a spring for operating the valve, and a gas injection nozzle 9 of metal, which is coupled to the gas generating means.

The rotary file 4 has a file body 10, which is formed by a wire member wound in a spiral form and cut to a given size and has a file face having a saw-tooth cross section, a file shaft 11 to which the file body 10 is fitted, a ratchet 12 which rotates together with the file shaft 11, an elastic pawl member 13 as a rotary body having engage pawls 17 which selectively engage with ratchet teeth 18 of the ratchet 12, and a file cover 16 which is installed by fitting coupling holes 15 over shafts 14 protruding from the elastic pawl member 13. As shown in FIGS. 2 and 3, the ratchet 12 is attached to one side of the file shaft 11, and has a plurality of saw-tooth ratchet teeth 18 with which the engage pawls 17 of the elastic pawl member 13 engage.

Figure 2:
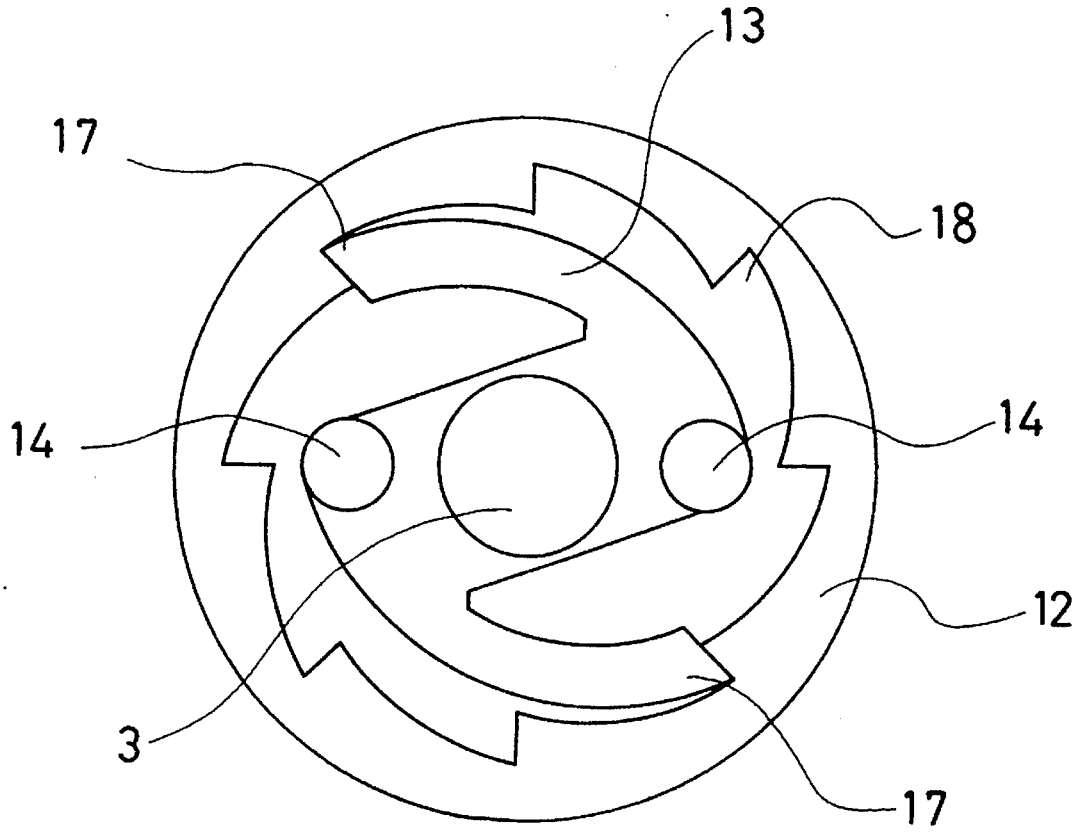
FIG. 2 is a side view showing the engagement of ratchet teeth with an elastic pawl member according to the first embodiment.
Figure 3:
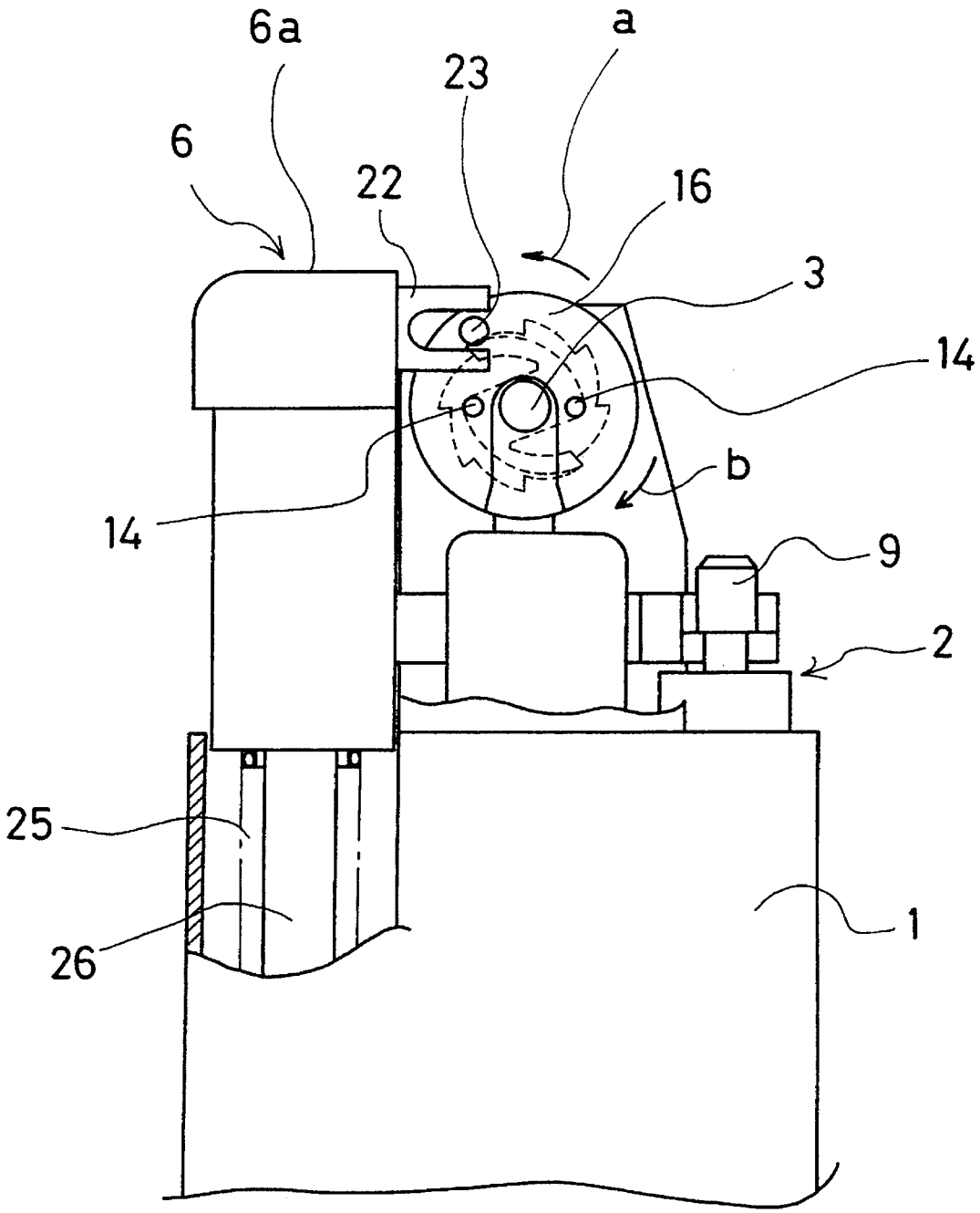
FIG. 3 is a side view showing the structures of the essential portions of the gas lighter according to the first embodiment.

As shown in FIGS. 2 and 3, the elastic pawl member 13 has a nearly Z shape at the front, and has the engage pawls 17 formed at the symmetrical end portions as already explained earlier. A through hole 19 where the support pin 3 of the file shaft 11 is fitted is formed at the center portion of the elastic pawl member 13. Provided at right and left side walls of the file cover 16 are inverse U-shaped recesses 21 in which the pin 3 of the file shaft 11 is fitted. The file cover 16 is provided with an engage shaft 23 which engages with engage portions 22 of the actuator 6. The file cover 16 is fitted over the file shaft 11 to which the file body 10, ratchet 12 and elastic pawl member 13 are attached.

The flint 5 is retained via a spring 24 in the flint retainer 8 provided in the lighter body 1. The flint 5 is retained in the flint retainer 8 with the spring 24 compressed, so that the upper end of the flint 5 is pressed against the file body 10 of the rotary file 4. As the file body 10 rubs against the flint 5, sparks are produced. A finger touching portion **6*a* is provided at the top of the actuator 6 attached to the lighter body 1. Protruding from the bottom of the actuator 6 is a shaft 26 over which a returning coil spring 25** as a returning elastic member is fitted.

The function of the gas lighter with the above structure will be described below. To use the gas lighter, the actuator 6 should be depressed first. As a result, the engage shaft 23 is depressed via the engage portions 22, causing the file cover 16 to rotate in the direction indicated by an arrow a in FIG. 3. The rotation of the file cover 16 causes the elastic pawl member 13 to rotates in the same direction via the coupling holes 15 of the file cover 16 and the engage pawls 17 of the elastic pawl member 13. As the elastic pawl member 13 rotates, the engage pawls 17 of the elastic pawl member 13 engage with the ratchet teeth 18 of the ratchet 12, thus rotating the file shaft 11 as shown in FIGS. 2 and 3. The rotation of the file shaft 11 rotates the rotary file 4, so that the flint 5 elastically abutting on the file body 10 of the rotary file 4 is rubbed, producing sparks. The sparks ignite the vapor gas injected from the gas injection means 2.

To stop the use of the gas lighter, the finger should be released from the actuator 6. As the finger is released from the actuator 6, the actuator 6 returns upward by the returning coil spring 25. Consequently, the file cover 16 rotates in the reverse direction (the direction indicated by an arrow b in FIG. 3) via the engage portions 22 and the engage shaft 23. The reverse rotation of the file cover 16 disengages the engage pawls 17 of the elastic pawl member 13 from the ratchet teeth 18 of the ratchet 12 so that the engage pawls 17 return freely to the original positions. At that time, the rotary file 4 does not rotate.

This embodiment has the following advantages. First, the components for rotating the rotary file 4 are easy to produce, so that the number of steps in the production can be reduced, thus reducing the manufacturing cost accordingly. This is because that the essential components for rotating the rotary file 4, such as the ratchet 12 and elastic pawl member 13, can be formed to finer parts by resin molding or the like, and they can be manufactured very easily as compared with the conventional production which involves the provision of segment portions on one side of the rotary file that is made by pressing metal wire pieces into a mold to be cast. Because of the easier production, the number of the ratchet teeth 18 of the ratchet 12 can be increased to reduce the required amount of depression of the actuator 6, without impairing the next engagement of the engage pawls 17 of the elastic pawl member 13 with the ratchet teeth 18.

Figure 4:
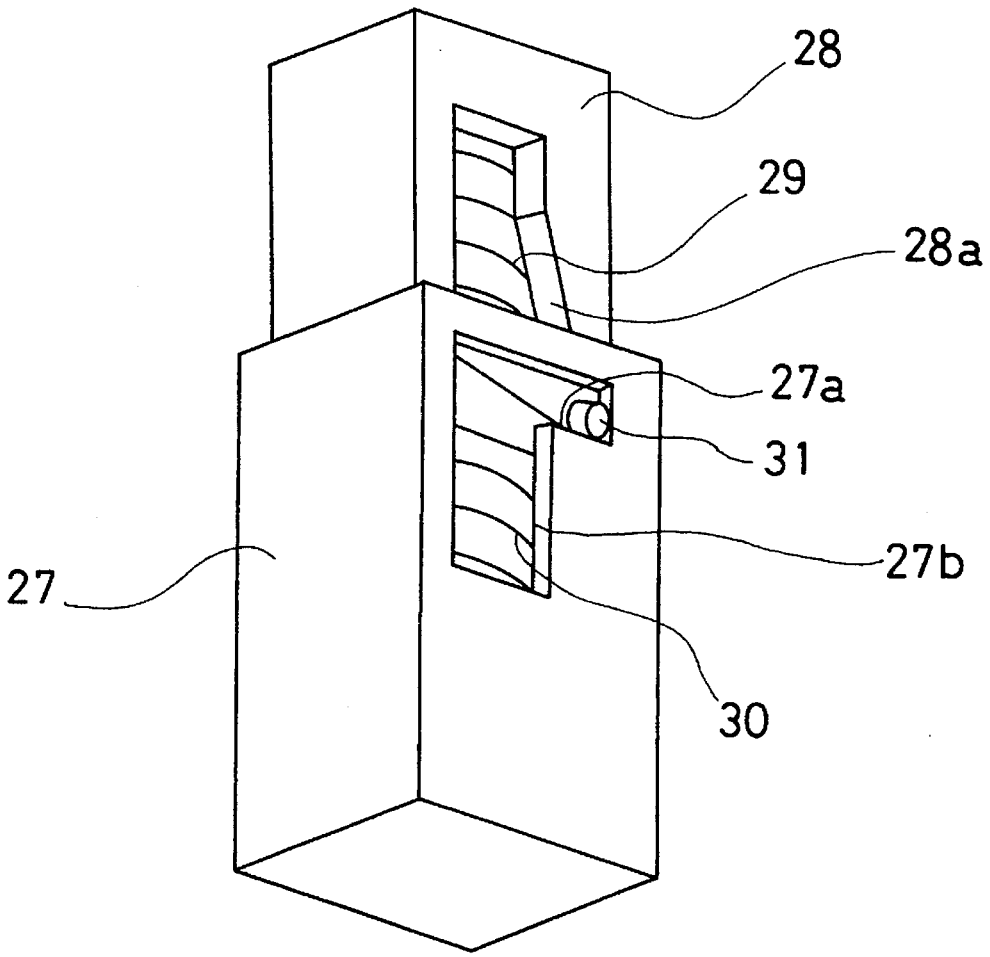
FIG. 4 is a perspective view showing the structures of a driving coil spring, a returning coil spring, etc. according to a second embodiment of the present invention.
Figure 5:
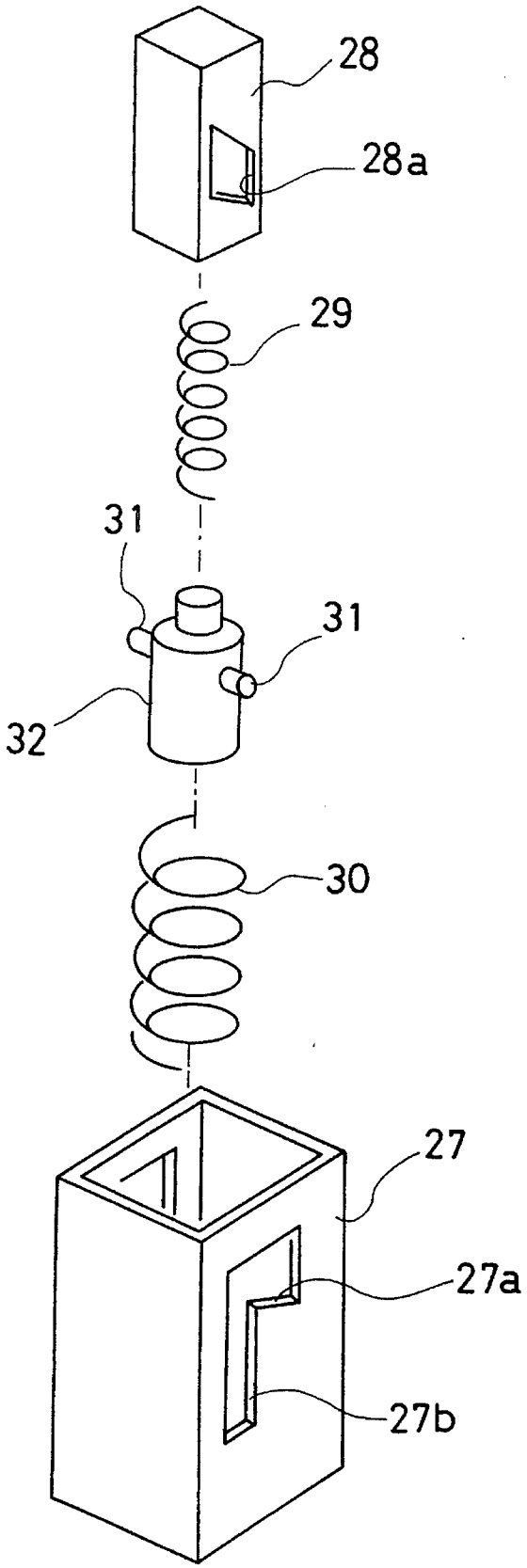
FIG. 5 is an exploded perspective view showing the structures of the driving coil spring, the returning coil spring, etc. according to the second embodiment.
Figure 6:
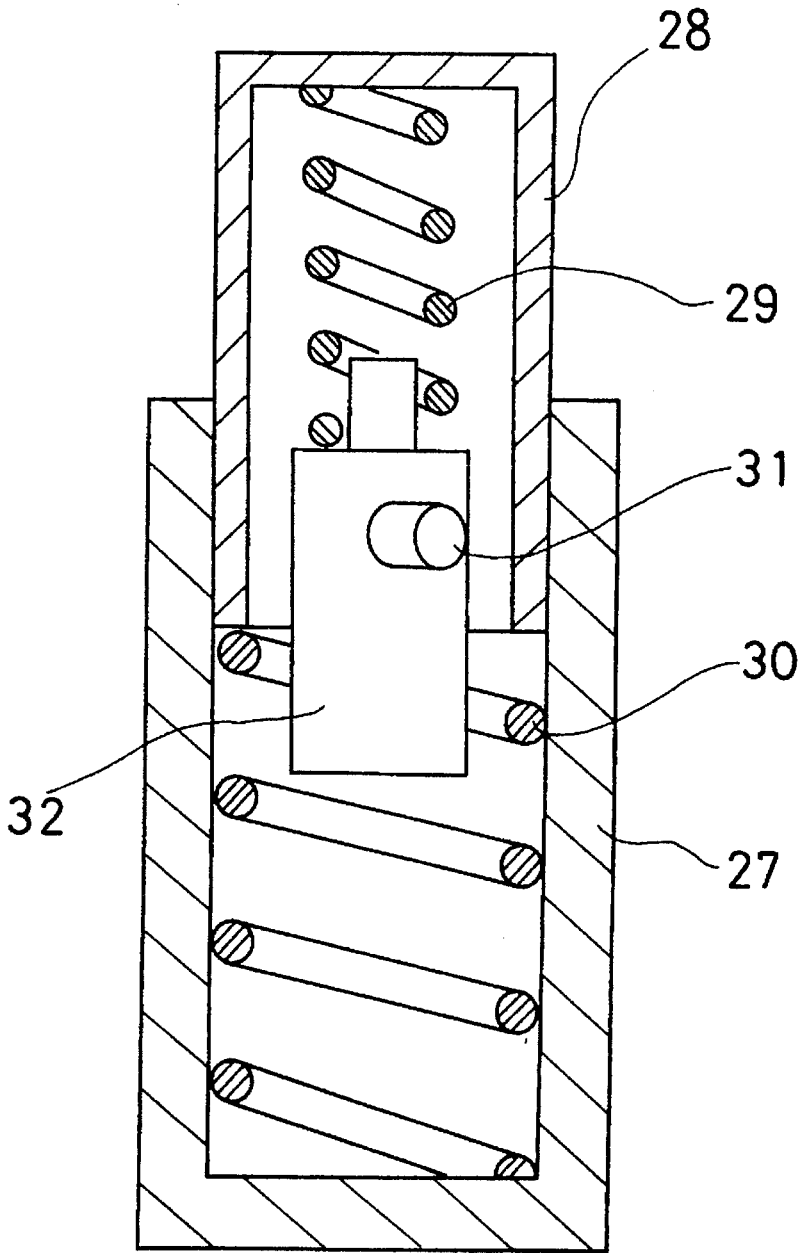
FIG. 6 is a cross-sectional view showing the structures of the driving coil spring, the returning coil spring, etc. according to the second embodiment.

A gas lighter according to a second embodiment of the present invention will now be described with reference to FIGS. 4 through 6. In this embodiment, a driving coil spring 29, a returning coil spring 30 and a movable member 32 with a cam pin 31 projecting therefrom are disposed between, for example, an outer box 27 and an inner box 28, which constitute a part of the push-down member. The file cover 16 is coupled to the cam pin 31, and an actuator (not shown) is coupled to the outer box 28. As the actuator is depressed, the repulsive force by the contraction of the driving coil spring 29 is accumulated and the repulsive force is spontaneously released by the depression of the actuator by a predetermined amount, imparting a swift rotational momentum to the rotary file 4 to produce sparks which ignite the gas injected from the gas injection means.

A more detailed description of the function will be given below. To use the gas lighter, the outer box 28 is depressed by means of the actuator first. This compresses the driving coil spring 29. As the cam pin 31 is engaged with an engaging step 27*a* formed on the outer box 27 at that time, the rotation is not transmitted to the file cover side. As the outer box 28 moves downward, the cam pin 31 is gradually urged leftward in FIG. 4 due to a cam groove 28*a* formed in the inner box 28. When the cam pin 31 is disengaged from the engaging step 27*a*, the cam pin 31 moves downward quickly along a groove 27*b*. This downward movement of the cam pin 31 spontaneously releases the compression of the driving coil spring 29 so that the spring 29 stretches. The stretching force (elastic recovering force) instantaneously acts on the file cover side via the cam pin 31, causing the rotary file 4 to rotate instantly. Therefore, the vapor gas injected from the gas injection means can surely be ignited.

With this structure that allows the driving coil spring 29 to accumulate the compression-oriented repulsive force, spontaneously releases and applies the repulsive force to the rotary file 4 so the flint 5 is rubbed against the file body to produce sparks, the rotary file 4 can be rotated spontaneously, thus improving the ignition efficiency. Even in a flint type ignition device using the flint 5 and rotary file 4, reliable ignition can be ensured by a similar operation to the operation of a piezoelectric type or battery type ignition device. What is more, since the flint type ignition device, unlike the piezoelectric type or battery type, does not need adjustment of the ignition energy or the ignition device, there is an advantage that the percentage of production defects of the ignition devices is low.

A third embodiment of the present invention will now be discussed with reference to FIGS. 7 through 9. This gas lighter has a push-down member 41, with a returning coil spring 43 attached to the bottom of the push-down member 41. A movable member 45 is movably disposed in the push-down member 41, and engage holes 47 (only one shown), which are to be coupled to the file cover side, are formed in the distal end of the movable member 45. A driving coil spring 49 is disposed between the movable member 45 and the push-down member 41. A slide member 51 having a tapered surface 51*a* is provided to be movable in the horizontal direction in the diagrams. This movable member 51 is urged leftward in the diagrams by, for example, an elastic member, to the position where it abuts on a stopper (not shown). An actuating portion 53 having a tapered surface 53*a* protrudes from the push-down member 41.

Figure 7:
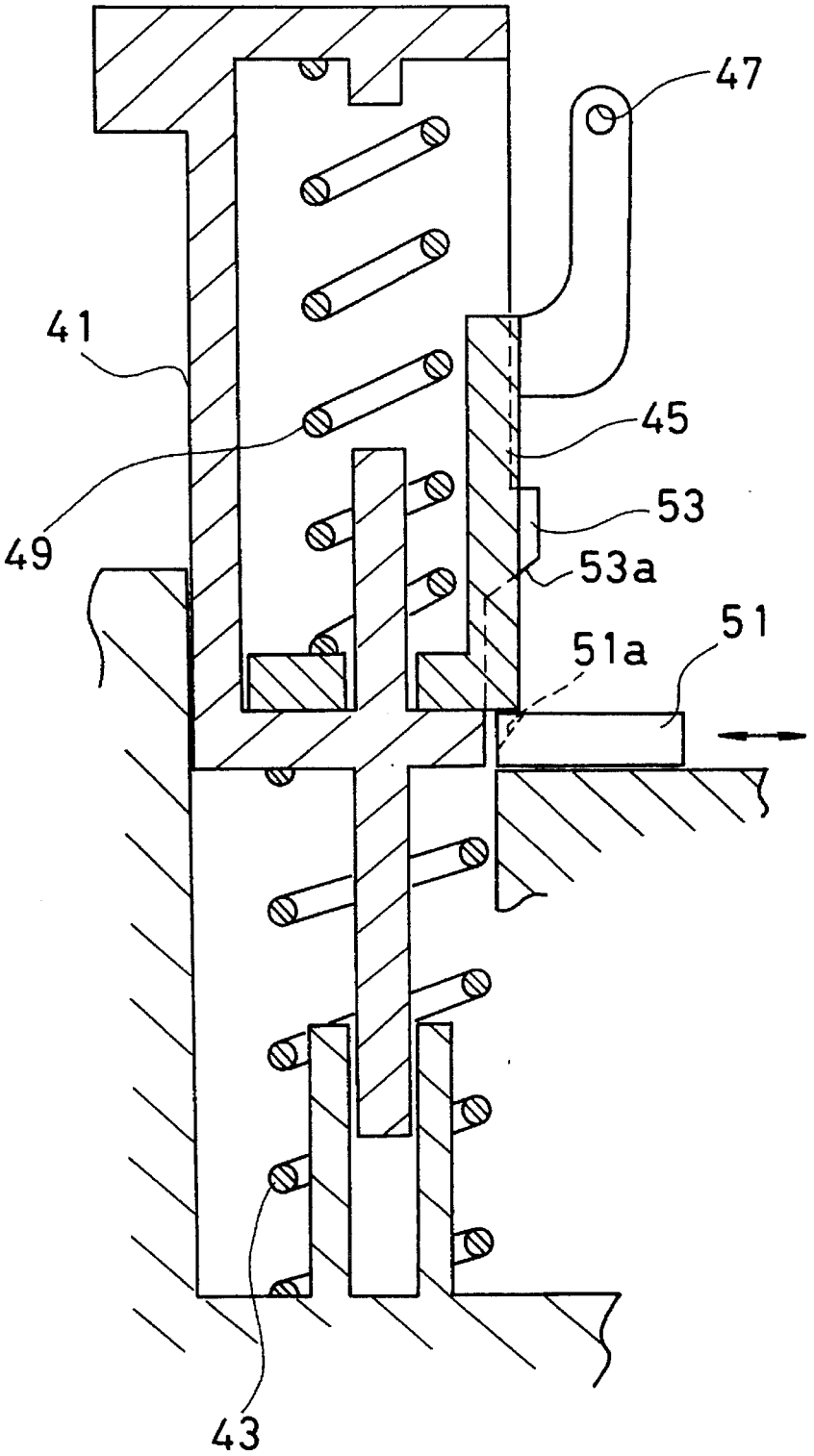
FIG. 7 is a cross-sectional view showing the structures of a driving coil spring, a returning coil spring, etc. according to a third embodiment of the present invention.
Figure 8:
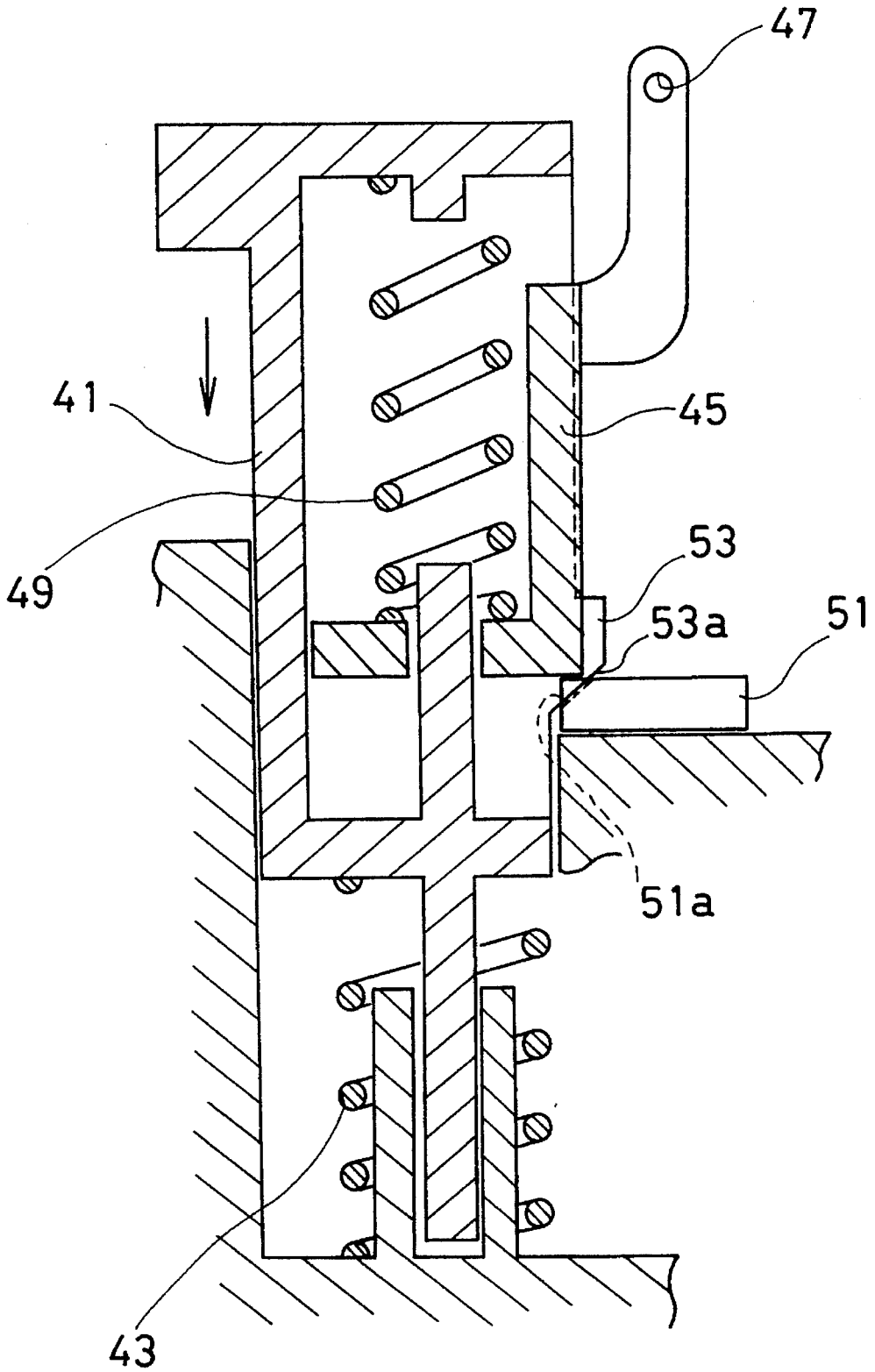
FIG. 8 is a cross-sectional view showing the structures of the driving coil spring, the returning coil spring, etc. according to the third embodiment.

When the gas lighter is not in use, it is in the state as shown in FIG. 7 where the bottom end of the movable member 45 abuts on the slide member 51. When the push-down member 41 is depressed to use the gas lighter, the push-down member 41 moves downward although the movement of the push-down member 41 is restricted by the bottom end of the movable member 45 abutting on the slide member 51, as shown in FIG. 8. As a result, the driving coil spring 49 is compressed, accumulating the spring force. When the push-down member 41 is depressed further down, the tapered surface 53*a* of the actuating portion 53 of the push-down member 41 abuts on the tapered surface 51*a* of the slide member 51, causing the slide member 51 to move rightward in the diagram.

Figure 9:
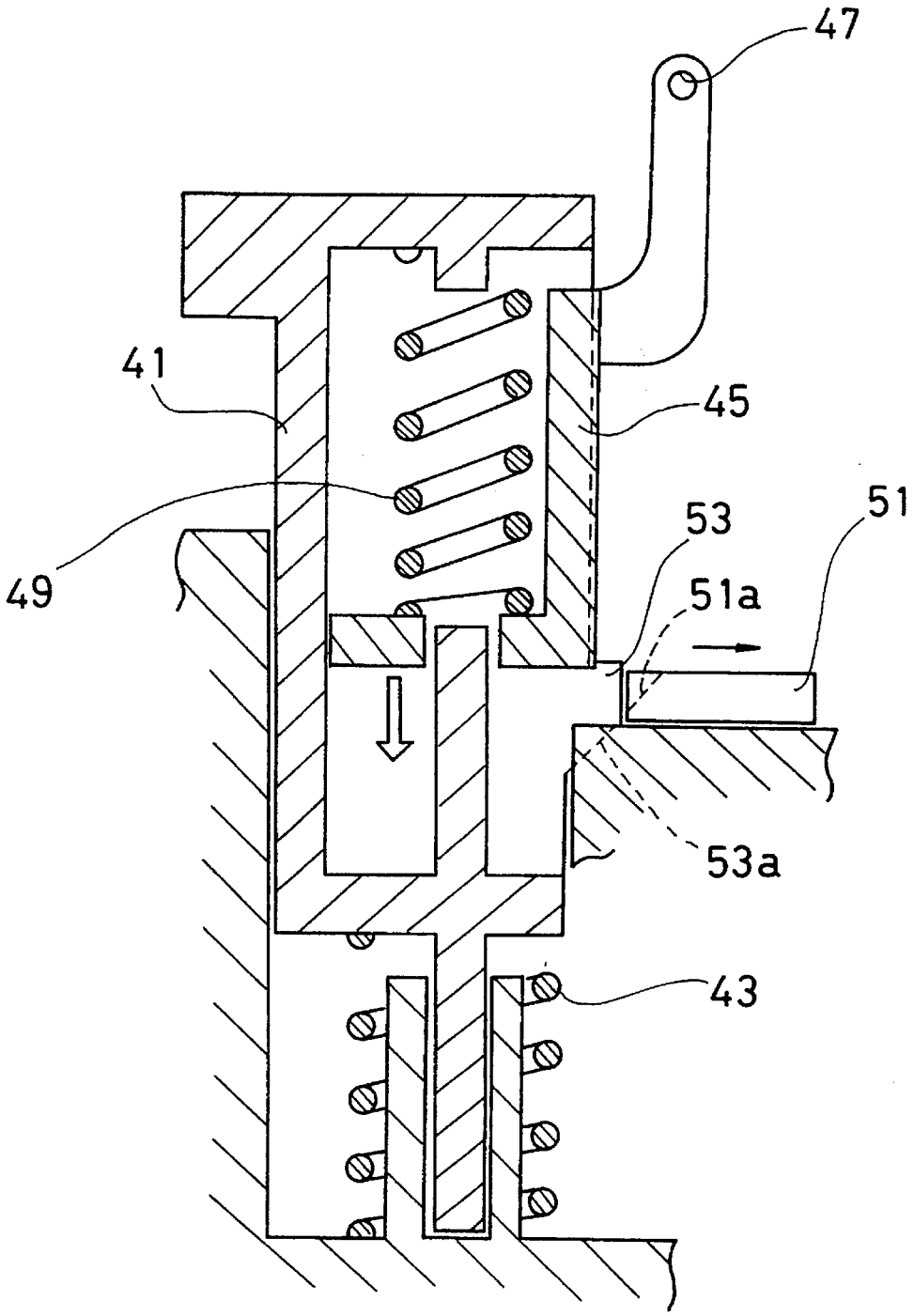
FIG. 9 is a cross-sectional view showing the structures of the driving coil spring, the returning coil spring, etc. according to the third embodiment.

When the slide member 51 moves to the position where the bottom end of the movable member 45 is separated from the slide member 51 as in the state shown in FIG. 9, the downward movement of the movable member 45 is permitted then. Then, the accumulated spring force is released instantaneously, causing the movable member 45 to move downward quickly. This rapid downward movement of the movable member 45 rotates the rotary file quickly. Therefore, the third embodiment has the same advantages ad the second embodiment.

The present invention is not limited to the first to third embodiments, but may be modified in various other forms without departing from the scope and spirit of this invention.

What is claimed is:

1. A gas lighter comprising:

a lighter body for retaining liquid gas and provided with gas injection means;

a push-down member depressably attached to said lighter body and urged in a direction opposite to a depressing direction by a returning elastic member, said push-down member having engage portions;

rotary ignition means rotatably attached to said lighter body, with a flint elastically abutting on said rotary ignition means, said rotary ignition means rubbing against said flint when being rotated;

a ratchet attached coaxially to said rotary ignition means and having a plurality of ratchet teeth on an inner surface thereof;

a rotary body attached to said ratchet coaxially and rotatably and having at least one engage pawl formed on an outer surface thereof, engageable with said ratchet teeth of said ratchet; and a cover, attached to said lighter body for covering said rotary ignition means, said ratchet and said rotary body being rotatable together with said rotary body, said cover having engage shafts engageable with said engage portions of said push-down member which, when said push-down member is depressed, cause said cover and said rotary body to rotate in a first direction, thereby causing said engage pawl to engage with said ratchet teeth of said ratchet thereby rotating said ratchet and said rotary ignition means to make sparks, and wherein when said push-down member is released, said cover and said rotary body rotate in a second direction opposite said first direction, thereby disengaging said engage pawl from said ratchet teeth.

2. The gas lighter as claimed in claim 1, wherein said rotary body has a pair of engage pawls at symmetrical positions, and said pair of engage pawls are respectively engaged with two ratchet teeth arranged at symmetrical positions of said ratchet.

3. The gas lighter as claimed in claim 1, further comprising a movable member linked to said rotary body so as to receive an urging force of said driving elastic member and retained movably in said push-down member, wherein depression of said push-down member compresses said driving elastic member and restricts movement of said movable member due to an engagement with said push-down member, and wherein when said push-down member is depressed by a predetermined amount, said movable member is disengaged from said push-down member to permit said movable member to move, thereby rotating said rotary body.

4. The gas lighter in claim 1, further comprising a movable member linked to said rotary body so as to receive an urging force of said driving elastic member and retained movably in said push-down member, wherein depression of said push-down member compresses said driving elastic member and restricts movement of said movable member due to an engagement of said movable member with a slide member disposed slidably, and wherein when said push-down member is depressed by a predetermined amount, said push-down member disengages said movable member from said slide member and an elastic force of said driving elastic member moves said movable member to thereby rotate said rotary body.

5. The gas lighter as claimed in claim 3, wherein said push-down member has an outer box and an inner box movable with respect to said outer box when said push-down member is depressed, and said movable member has a cam pin engageable with an engage step portion of said outer box, whereby depression of said inner box compresses said driving elastic member and restricts movement of said movable member due to an engagement of said cam pin with said engage step portion, and wherein when said push-down member is depressed by a predetermined amount, said cam pin moves along a cam groove of said inner box to be disengaged from said engage step portion to disengage said movable member from said outer box, thereby causing said movable member to move, thus rotating said rotary body.

6. The gas lighter as claimed in claim 4, wherein said movable member has a tapered surface, and movement of said movable member is restricted by an abutment of a lower end of said movable member against said slide member at a beginning of depression of said push-down member, and wherein when said push-down member is depressed by a predetermined amount, said tapered surface of said movable member abuts on a tapered surface of said slide member to thereby move said slide member to be disengaged from said movable member, thus permitting an elastic force of said driving elastic member to move said movable member to thereby rotate said rotary body.

* * * * *